US006840872B2

(12) United States Patent
Yoneyama

(10) Patent No.: US 6,840,872 B2
(45) Date of Patent: Jan. 11, 2005

(54) GOLF CLUB HEAD

(75) Inventor: Kosaku Yoneyama, Tokyo (JP)

(73) Assignee: Yonex Kabushiki Kaisha, Tokyo (JP)

( * ) Notice: Subject to any disclaimer, the term of this patent is extended or adjusted under 35 U.S.C. 154(b) by 63 days.

(21) Appl. No.: 10/342,249

(22) Filed: Jan. 15, 2003

(65) Prior Publication Data

US 2003/0144079 A1 Jul. 31, 2003

(30) Foreign Application Priority Data

Jan. 29, 2002 (JP) ..... 2002-019442

(51) Int. Cl.[7] ..... A63B 63/04

(52) U.S. Cl. ..... 473/346; 473/345; 473/349; 473/350

(58) Field of Search ..... 473/324, 345, 473/346, 350, 329, 342

(56) References Cited

U.S. PATENT DOCUMENTS 5,993,331 A 11/1999 Shieh

2001/0051548 A1 12/2001 Iwata et al.

FOREIGN PATENT DOCUMENTS

| | | |
|---|---|---|
| EP | 0838245 A2 | 4/1998 |
| JP | 9-192273 | 7/1997 |
| JP | 10/258142 | 9/1998 |

*Primary Examiner*—Raleigh W. Chiu

(74) *Attorney, Agent, or Firm*—Wenderoth, Lind & Ponack, L.L.P.

(57) ABSTRACT

A golf club head has a face plate of high strength and high resilience and which provides excellent directional stability of the ball trajectory. The golf club head comprises a thick-walled portion 3 at the center of the face plate 2, and at least four narrow ribs 4*a* and 4*b*. Each of the ribs is formed with a thickness not substantially exceeding the thickness of the thick-walled portion, and extends radially from the thick-walled portion toward the perimeter of the face plate. Thin-walled portions 5 are formed between the thick-walled portion and the narrow ribs.

17 Claims, 1 Drawing Sheet

SECTION B-B'

SECTION B-B'

SECTION A-A'

GOLF CLUB HEAD

CROSS-REFERENCE TO RELATED APPLICATIONS

The present application claims priority upon Japanese Patent Application No. 2002-19442 filed on Jan. 29, 2002, which is herein incorporated by reference.

BACKGROUND OF THE INVENTION

1. Field of the Invention

The present invention relates to a hollow golf club head which has a face plate attached on the front face of the head body and is made of lightweight metal such as a titanium alloy.

2. Description of the Related Art

To obtain high resilience at the face of the golf club head, conventional golf club heads of the driver or wood type have been disclosed which increase the face plate area size in conjunction with increasing the overall volume of the golf club head. Some of the proposed golf club heads have an overall volume of more than 400 cc.

However, increasing both the area of the face plate and the overall volume of the club head leads accordingly to an increase of the face weight. Therefore, a technique has been proposed which decreases the thickness of the face plate while keeping the increase of the face plate weight as little as possible.

However, by uniformly decreasing the thickness of the overall face plate, a sufficient thickness at the sweet spot which frequently strikes a golf ball cannot be maintained, thus resulting in breakage at the spot and failure in to impart high resilience to the ball.

In view of the above problems, as disclosed in Japanese Patent Laid-Open (Kokai) Publication No. 9-192273, golf club head has been proposed which attains an improved resilience by forming the central portion of the face plate to be thick, and forming the perimeter thereof to be thin.

However, this conventional golf club head may show good performance when a ball is hit at the central thick portion of the face plate, but has problems when a golf ball is hit off center. For example, when a ball is hit at the boundary between the thick and thin portions, ball flight deviation occurs, and when a ball is hit at the thin portion, significant distance loss occurs. Moreover, the above-described conventional golf club head has a problem in that repeated use tends to result in cracking at the boundary part between the thick and thin portions.

The present invention has been made in view of the above problems, and its object is to provide a golf club head having a face plate of high strength and high resilience and having an excellent directional stability of the ball trajectory.

SUMMARY OF THE INVENTION

In order to achieve the above object, the present invention provides a golf club head comprising a hollow head body and a face plate made of a lightweight highly resilient metal and which is attached to the front face of the head body. The face plate comprises a thick-walled portion at the center thereof, and at least four narrow ribs. Each of the ribs is formed with a thickness not substantially exceeding the thickness of the thick-walled portion, and extends radially from the thick-walled portion toward the perimeter of the face plates. Thin-walled portions are formed between the thick-walled portion and the narrow ribs.

When a golf ball is hit at the central thick-walled portion of the face plate having the above construction, the springy property of the broad thin-walled portions at the perimeter thereof (in addition to the effect of lightweight metal with high resilience) imparts high repulsion to the ball, thus resulting in great flight distance.

Moreover, even when a golf ball is hit at a point off-set from the central thick-walled portion of the face plate, because the narrow rib exists at or near the point, and because the rib has high resilience due to its thickness being approximately of the same thickness as the central thick-walled portion, the ball flight deviation is prevented unlike the conventional case where a golf ball is hit at the boundary between the thick and thin portions.

Furthermore, the perimetric part surrounding the central thick-walled portion is not a uniformly thin-walled portion as in a conventional head. Instead, the surrounding part comprises the thin-walled portions which are reinforced by the narrow radial ribs so as to impart high strength to the overall face plate, thus preventing cracking from occurring between the central thick-walled portion and the thin-walled portions outside it.

It is preferable that the narrow ribs comprise a plurality of generally horizontal narrow ribs and a plurality of generally vertical narrow ribs.

The present invention is a construction suitable for club heads with a volume of 300 to 460 cc.

It is preferable that the number of ribs is in a range of 6 to 14, and that each of the radially extending narrow ribs has an approximately uniform lateral width perpendicular to the radial direction.

Further, it is preferable that each of the generally horizontal narrow ribs has a thickness substantially equal to that of the central portion, and that each of the generally vertical narrow ribs are formed to progressively decrease in thickness from the central portion toward the perimeter.

Furthermore, it is preferable that the thin-walled portions are formed to progressively decrease in thickness from the central portion toward the perimeter, and that the thin-walled portions, each defined between two adjacent narrow ribs, have an approximately equal radial angle from the center of the face plate.

Furthermore, it is preferable that the central thick-walled portion has a substantially rectangular shape, with a vertical side having about ⅓ the vertical length of the head body and a horizontal side of about ⅓ the horizontal length of the head body, respectively, and a thickness of about 2.5 mm.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

Figure 1:
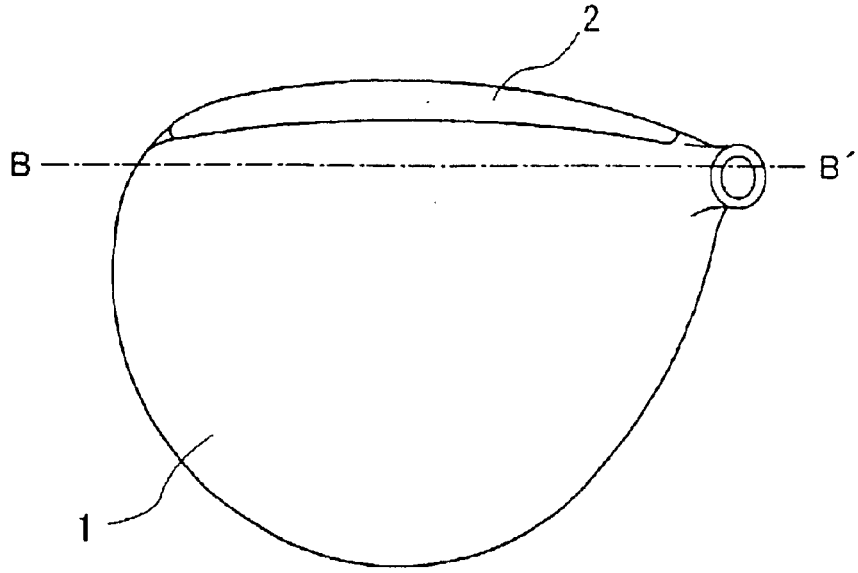
FIG. 1 is a plan view of the golf club head of the 25 present invention.

A preferred embodiment of the present invention will be described hereinafter with reference to the accompanying drawings.

A golf club head of the present invention comprises a head body 1 and a face plate 2. The present invention will produce an excellent effect when applied to a club head having a head volume of 300 to 460 cc and a face area of 40 $cm^2$.

At the center of the face plate 2 which is made of titanium alloy, is a rectangular central thick-walled portion 3, which has a horizontal side with a length about ⅓ the horizontal length of the face plate, and a vertical side with a length about ⅓ the vertical length of the face plate, respectively, measured along the center lines thereof. Two generally horizontal narrow ribs 4*a* are formed to extend radially from each of the right and left sides of the central thick-walled portion 3 toward the perimeter. Three generally vertical narrow ribs 4*b* are formed to extend radially from each of the top and bottom sides of the central thick-walled portion 3 to the perimeter.

The central thick-walled portion is formed to have a thickness of, for example, 2.5 mm, and the generally horizontal narrow ribs 4*a* are formed to have, over their entire length, the same thickness of 2.5 mm as the central portion. On the other hand, the thickness of the generally vertical narrow rib 4*b* is gradually changed so that the part adjacent to the central thick-walled portion 3 has a thickness of 2.5 mm, while the perimetric part (distal end part) thereof has a thickness of 2.0 mm. This arrangement is preferable, since the number of generally vertical narrow ribs 4*b* is greater than that of the generally horizontal narrow ribs 4*a*, and the length of each generally vertical narrow rib 4*b* is shorter than that of each generally horizontal narrow rib 4*a*. By making the thickness of each generally vertical narrow rib at the perimeter thinner than that of each generally horizontal narrow rib, the generally vertical narrow ribs can have higher flexibility than the generally horizontal narrow ribs.

Generally fan shaped thin-walled portions 5 are delimited by the central thick-walled portion 3 and the narrow ribs 4*a* and 4*b*, and the thickness of the thin-walled portion 5 progressively decreases from the part thereof adjacent to the central thick-walled portion 3 toward the perimeter, thus resulting in a thickness of about 1.8 mm at the perimeter.

The golf club head of the present invention is preferably constructed such that when the central thick-walled portion 3 hits a golf ball, the face plate 2 rebounds the ball as a trampoline. Thus, it is preferable to make the width (lateral width) of the narrow ribs 4*a*, 4*b* in the direction perpendicular to the radial direction thereof as small as possible, and to make the thin-walled portions 5 thin, so that this part of the face has increased resilience in the direction perpendicular to the face plate. The width of the narrow ribs and the thickness of the thin-walled portion are determined by the necessity of maintaining the strength of the face plate greater than the predetermined strength. The present invention permits making the thickness of the thin-walled portions considerably thinner than that of the conventional head without any narrow ribs, namely, as small as about 1.0 mm.

The number (quantity) of the narrow ribs is at least 4 and preferably 6 or more in view of the relation between the structural strength and the resilience of the overall face plate. Further, the number of the narrow ribs can be determined by the relation between the lateral width thereof and the area of the face plate, preferably in the range of 6 to 14. In this case, a plurality of thin-walled portions 5 are formed in the shape of a fan between the adjacent narrow ribs. It is preferable to provide the thin-walled portions which, each defined between adjacent narrow ribs, all have an approximately equal radial angle from the center of the face plates The number and lateral width of the narrow ribs are related such that the greater the number of the narrow ribs, the smaller the width of the narrow ribs can be made, and the smaller the number of the narrow ribs, the larger the width of the narrow ribs can be made. If the number of the narrow ribs is 10 as in the preferred embodiment, the rib width is in the range of 1.0 mm to 2.0 mm. If the number of narrow ribs is 6, the narrow rib width is in the range of 1.5 mm to 2.5 mm. If the number of narrow ribs is 14, the narrow rib width is in the range of 0.5 mm to 1.5 mm.

Figure 2:
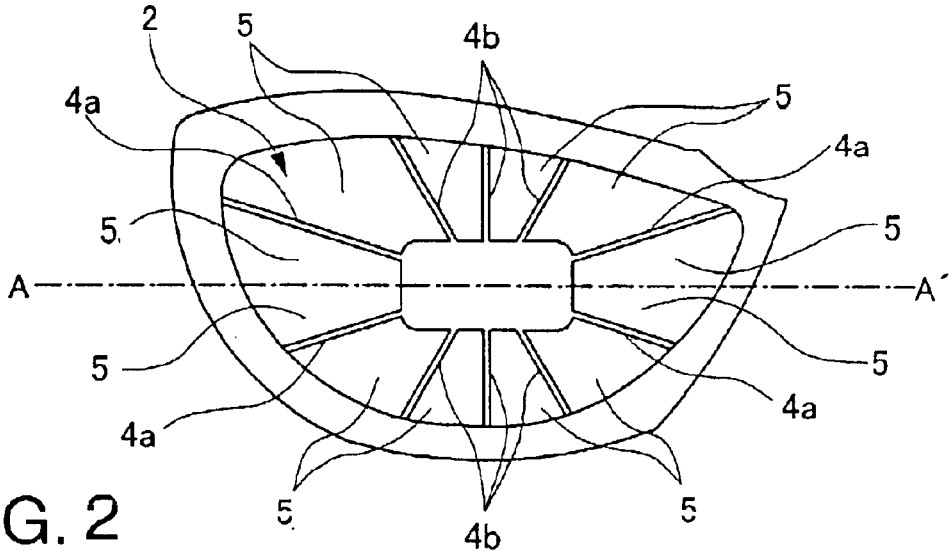
FIG. 2 is a front view of the golf club head of the present invention, taken along line B—B in FIG. 1, and showing the boundaries of concave and convex surfaces of the backside of the face plate 2 in solid lines.
Figure 3:
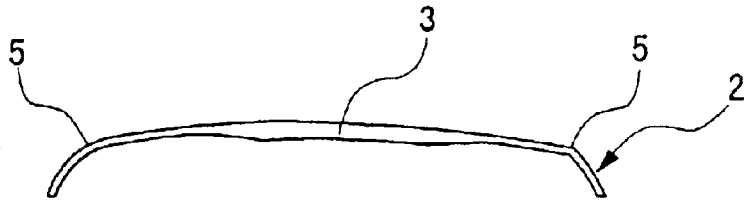
FIG. 3 is a cross sectional view, taken along line A—A in FIG. 2, of the face plate of this golf club head.

The shape of the central thick-walled portion 3 is not limited to a rectangle as in the preferred embodiment, and alternatively can be an elongated ellipse or polygon. As for its dimensions, in the preferred embodiment as shown in the rear view of FIG. 2, the central thick-walled portion 3 has horizontal and vertical lengths about ⅓ the horizontal and vertical lengths of the face plate, respectively, measured along the lines passing through the center thereof. The central thick-walled portion 3 can have horizontal and vertical lengths in a range of about ¼ to ⅖ (25% to 40%) the horizontal and the vertical lengths of the face plate, respectively.

The area of the central thick-walled portion 3 of the face plate, the number and width of the narrow ribs 4*a*, 4*b*, the thicknesses, etc., described above can be suitably and easily altered according to the face plate size or the type of club head such as driver, spoon, buffer, cleek or the like.

Although the preferred embodiment of the present invention has been described in detail, it should be understood that various changes, substitutions and alterations can be made therein without departing from the spirit and scope of the inventions as defined by the appended claims.

What is claimed is:

1. A golf club head comprising:

a hollow body; and a face plate made of a lightweight highly resilient metal and attached to a front face of said hollow body, said face plate including:

a central thick-walled portion;

a quantity of 6 to 14 narrow ribs, each of said narrow ribs having a thickness not substantially exceeding a thickness of said central thick-walled portion and extending radially from said central thick-walled portion toward a perimeter of said face plate; and thin-walled portions arranged between said central thick-walled portion and said narrow ribs.

2. The golf club head of claim 1, wherein each of said narrow ribs has an approximately uniform lateral width with respect to a direction perpendicular to the radial direction.

3. The golf club head of claim 1, wherein each of said thin-walled portions has a thickness progressively decreasing from said central thick-walled portion toward said perimeter of said face plate.

4. The golf club head of claim 1, wherein each of said thin-walled portions is delimited between an adjacent pair of said narrow ribs, and is shaped to form an approximately equal radial angle from the center of said face plate.

5. The golf club head of claim 1, wherein said central thick-walled portion has a substantially rectangular shape, with each vertical side having a length in a range of 25% to 40% of the vertical length of said face plate, and with each horizontal side having a length in a range of 25% to 40% of the horizontal length of said face plate.

6. The golf club head of claim 1, wherein said central thick-walled portion has a substantially rectangular shape, each of a group of said narrow ribs extending from each vertical side of said central thick-walled portion having a substantially uniform thickness substantially equal to a thickness of said central thick-walled portion, and each of a group of said narrow ribs extending from each horizontal side of said central thick-walled portion having a thickness progressively decreasing from said central thick-walled portion toward said perimeter of said face plate.

7. A golf club head comprising:

a hollow body; and a face plate made of a lightweight highly resilient metal and attached to a front face of said hollow body, said face plate including:

a central thick-walled portion;

at least four narrow ribs including a group of generally horizontal narrow ribs and a group of generally vertical narrow ribs, each of said narrow ribs having a thickness not substantially exceeding a thickness of said central thick-walled portion and extending radially from said central thick-walled portion toward a perimeter of said face plate, each of said group of generally horizontal narrow ribs having a thickness substantially equal to a thickness of said central thick-walled portion, and each of said group of generally vertical narrow ribs having a thickness progressively decreasing from said central thick-walled portion toward said perimeter of said face plate; and thin-walled portions arranged between said central thick-walled portion and said narrow ribs.

8. The golf club head of claim 7, wherein each of said narrow ribs has an approximately uniform lateral width with respect to a direction perpendicular to the radial direction.

9. The golf club head of claim 7, wherein each of said thin-walled portions has a thickness progressively decreasing from said central thick-walled portion toward said perimeter of said face plate.

10. The golf club head of claim 7, wherein each of said thin-walled portions is delimited between an adjacent pair of said narrow ribs, and is shaped to form an approximately equal radial angle from the center of said face plate.

11. The golf club head of claim 7, wherein said central thick-walled portion has a substantially rectangular shape, with each vertical side having a length in a range of 25% to 40% of the vertical length of said face plate, and with each horizontal side having a length in a range of 25% to 40% of the horizontal length of said face plate.

12. A golf club head comprising:

a hollow body; and a face plate made of a lightweight highly resilient metal and attached to a front face of said hollow body, said face plate including:

a central thick-walled portion having a substantially rectangular shape with vertical sides each having a length about ⅓ of the length of the vertical center line of said hollow body, and with horizontal sides each having a length about ⅓ of the length of the horizontal center line of said hollow body;

at least four narrow ribs, each of said narrow ribs having a thickness not substantially exceeding a thickness of said central thick-walled portion and extending radially from said central thick-walled portion toward a perimeter of said face plate; and thin-walled portions arranged between said central thick-walled portion and said narrow ribs.

13. The golf club head of claim 12, wherein said central thick-walled portion has a thickness of about 2.5 mm.

14. The golf club head of claim 12, wherein each of said narrow ribs has an approximately uniform lateral width with respect to a direction perpendicular to the radial direction.

15. The golf club head of claim 12, wherein each of said thin-walled portions has a thickness progressively decreasing from said central thick-walled portion toward said perimeter of said face plate.

16. The golf club head of claim 12, wherein each of said thin-walled portions is delimited between an adjacent pair of said narrow ribs, and is shaped to form an approximately equal radial angle from the center of said face plate.

17. The golf club head of claim 12, wherein each of a group of said narrow ribs extending from each vertical side of said central thick-walled portion having a substantially uniform thickness substantially equal to a thickness of said central thick-walled portion, and each of a group of said narrow ribs extending from each horizontal side of said central thick-walled portion having a thickness progressively decreasing from said central thick-walled portion toward said perimeter of said face plate.

* * * * *